US010850962B2

(12) United States Patent
Idsäter

(10) Patent No.: US 10,850,962 B2
(45) Date of Patent: Dec. 1, 2020

(54) CLAMPING DEVICE FOR A FORKLIFT AND A FORKLIFT HAVING SUCH A CLAMPING DEVICE

(71) Applicant: PMC Attachment AB, Vaggeryd (SE)

(72) Inventor: Per Idsäter, Värnamo (SE)

(73) Assignee: PMC Attachment AB

( * ) Notice: Subject to any disclaimer, the term of this patent is extended or adjusted under 35 U.S.C. 154(b) by 0 days.

(21) Appl. No.: 16/622,378

(22) PCT Filed: Jun. 13, 2018

(86) PCT No.: PCT/SE2018/050617

§ 371 (c)(1),
(2) Date: Dec. 13, 2019

(87) PCT Pub. No.: WO2018/231134

PCT Pub. Date: Dec. 20, 2018

(65) Prior Publication Data

US 2020/0198950 A1 Jun. 25, 2020

(30) Foreign Application Priority Data

Jun. 15, 2017 (SE) ..... 1750763

(51) Int. Cl.
*B66F 9/18* (2006.01)

(52) U.S. Cl.
CPC ..... *B66F 9/18* (2013.01)

(58) Field of Classification Search
CPC .... B66F 9/18; B66F 9/00; B66F 9/075; B66F 9/12; B66F 17/00
See application file for complete search history.

(56) References Cited

U.S. PATENT DOCUMENTS 3,272,364 A * 9/1966 Mindrum ..... B66F 9/18 414/622
3,412,882 A * 11/1968 Stockwell ..... A01D 90/08 414/469
3,493,137 A * 2/1970 Nilsen ..... B66F 9/18 414/608
3,633,778 A * 1/1972 Ide ..... B66F 9/18 414/622
3,773,202 A * 11/1973 Dutra, Jr. ..... B66F 9/18 414/622

(Continued)

FOREIGN PATENT DOCUMENTS

CN 104671156 A 6/2015
JP H 0218299 A 1/1990

*Primary Examiner* — Kaitlin S Joerger
(74) *Attorney, Agent, or Firm* — Condon Roccia Koptiw LLP

(57) ABSTRACT

The invention relates to a clamping device (5) for a forklift (1). The clamping device (5) comprises a body (6) connectable to the forklift (1) at a loading area thereof, a clamping arm (7) connected to the body (6), the clamping arm (7) being moveable in relation to the body (6), and a drive unit arranged to move the clamping arm (7) between an idle position, in which the clamping arm (7) is located outside of the loading area, and a working position, in which the clamping arm (7) has been moved into the loading area to secure a load (2) carried by the forklift (1). The invention also relates to a forklift (1) for transporting a load (2).

10 Claims, 3 Drawing Sheets

(56) References Cited

U.S. PATENT DOCUMENTS

| | | | | | |
|---|---|---|---|---|---|
| 4,354,795 | A | * | 10/1982 | Dutra, Jr. | B66F 9/18 294/67.22 |
| 4,497,607 | A | * | 2/1985 | Johansson | B66F 9/12 414/664 |
| 4,659,277 | A | * | 4/1987 | Widener | B66F 9/18 191/12.2 R |

* cited by examiner

CLAMPING DEVICE FOR A FORKLIFT AND A FORKLIFT HAVING SUCH A CLAMPING DEVICE

CROSS REFERENCE TO RELATED APPLICATIONS

This application is the National Stage Entry under 35 U.S.C. § 371 of Patent Cooperation Treaty Application No. PCT/SE2018/050617, filed Jun. 13, 2018, which claim priority from Swedish Patent Application No. 1750763-3, filed Jun. 15, 2017, the contents of which are hereby incorporated by reference herein.

TECHNICAL FIELD

The invention relates to a clamping device for a forklift. The invention also relates to forklift equipped with a clamping device.

BACKGROUND ART

Industrial forklift trucks have been available to the materials handling industry for a number of years and most are of common design.

Conventional forklift trucks customarily carry a vertically oriented mast assembly to which a carriage assembly is mounted for elevational movement therealong to raise the load up to a desired elevation. The carriage assembly is provided with a pair of spaced apart, generally parallel forks that overhang from the carriage assembly so as to take up the vertically exerted force of the load. The up and down movement of the carriage assembly may be rendered effective by the combination of a lift jack and a lift chain associated therewith. Side shift cylinders are also employed to have the carriage assembly move laterally, if appropriate. Lateral movement of the carriage assembly makes it possible for the forklift truck to readily access to the load even in a narrow working space and to permit unshipment of the lifted load on a precise location.

U.S. Pat. No. 3,477,600 discloses a forklift having a typical vertical frame for movement thereon of a standard carriage to which is attached the horizontal fork arms. This particular forklift truck with its carriage as disclosed is one for picking up loads through the horizontal fork arms and providing the load support with the fork arms as the load is carried to its destination. Well known mechanisms such as shown in the Sawyer patent are available for vertically positioning the carriage member on the vertical frame. This function is provided, of course, to allow the carried load to be discharged at various vertical levels as desired. In some forklift truck designs, the entire vertical frame and carriage assembly is tiltable, generally at a point close to the ground, such that a load being carried can be supported in a more efficient manner; not only through the horizontal fork arms, but also through resting against the carriage.

The disadvantage in a forklift carriage and horizontal fork arm assembly, as described above, is that with only fork arms, the lift truck will not be able to pick up and carry other types of loads such as cylindrical loads, or a plurality of rectangular loads such as pulp bales. To solve this problem different types of clamping solutions for forklifts have been developed.

However, a problem with existing clamping solutions for forklifts is the lack of movability and flexibility of the same.

SUMMARY OF THE INVENTION

It is an objective of the present invention to provide an improvement of the above technique and prior art. More particularly, it is an objective of this invention to provide an improved clamping device for a forklift.

According to a first aspect, these and other objects, and/or advantages that will be apparent from the following description of embodiments, are achieved, in full or at least in part, by a clamping device for a forklift. The clamping device comprises a body connectable to the forklift at a loading area thereof, a clamping arm connected to the body, the clamping arm being moveable in relation to the body, and a drive unit arranged to move the clamping arm between an idle position, in which the clamping arm is located outside of the loading area, and a working position, in which the clamping arm has been moved into the loading area to secure a load carried by the forklift. The clamping device provides for a secure and efficient handling of the load that is to be transported by the forklift.

This specific clamping device is advantageous in that the clamping device is extremely flexible and can be moved in several different planes and directions. It is also a compact device which, when in its idle position, will not disturb the user of the forklift or block the view upon transport of the same.

The clamping device is further advantageous in that it can be ordered as a separate kit and mounted onto an already existing forklift in order to improve the overall safety of the same. The vertical position of the idle position may be adjusted so that the clamping device fits with fork lifts with or without cargo support.

The clamping arm may be movable in relation to the body in a vertical direction and rotatable in the horizontal plane. Preferably, a first portion of the clamping arm is movable in relation to the body in a vertical direction and a second portion of the clamping arm is pivotable in the horizontal plane. Here, the second portion of the clamping arm may be pivotably arranged to the first portion of the clamping arm. The second portion of the clamping arm may also be vertically pivotable.

The high flexibility of the clamping arm will make it possible to arrange the clamping arm in direct contact with the main body of the forklift when not in use and thus in its idle position. This makes the clamping device compact and provides for an improved safety in terms of an improved drivers view.

The drive unit may comprise a first drive means for moving the first portion of the clamping arm and a second drive means for driving the second portion of the clamping arm.

The clamping device may further comprise at least one sensor arranged on the clamping arm and connected to a control unit. In this case, the control unit is adapted to stop the drive unit based on information from the at least one sensor. This is a way to avoid potential collisions when the clamping device is in use. Should the at least one sensor of the clamping arm detects an obstacle it can be maneuvered by means of the control unit to avoid a collision.

The control unit may be adapted to stop the drive unit based on load threshold value of the drive unit. In other words, when the control unit senses that the drive unit is exposed to a load, the drive unit is stopped.

The at least one sensor may comprise any one chosen from the group consisting of a pressure sensor, an optical sensor and a proximity sensor.

The clamping device may be controlled by a control system controlling the movements of the clamping device and handling the signals from the sensors of the clamping device. The control system may e.g. be a Programmable Logic Controller (PLC) programmed to perform the logical functions described herein. The control system of the clamping device may optionally be made compatible with a CAN-bus system so as to integrate with a fork lift native control system.

The control system may further be remotely operated by an operator. The remote operation of the control system may e.g. be performed by a driver of the driver cabin of the fork lift. The remote operation of the control system may be performed via a wireless remote control so that the operation of the clamping device may be performed at any location.

Light signals and/or a sound signals may be used to indicate the idle position and the working position or any other position of the clamping device. Also sensor signals may be indicated by such signals.

According to a second aspect, these and other objects are achieved, in full or at least in part, by a forklift for transporting a load. The forklift comprises a main body, at least two forks connected to the main body of the forklift for carrying a load, and a clamping device according to the features above. The body of the clamping device is attached to the forklift at a side surface of the main body thereof and adjacent to a connection point between the main body and one of the at least two forks.

Effects and features of the second aspect of the present invention are largely analogous to those described above in connection with the first aspect of the inventive concept. Embodiments mentioned in relation to the first aspect of the present invention are largely compatible with the further aspects of the invention.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

As used herein, the term "comprising" and variations of that term are not intended to exclude other additives, components, integers or steps.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, where the same reference numerals may be used for similar elements, and wherein.

DETAILED DESCRIPTION OF PREFERRED EMBODIMENTS OF THE INVENTION

Figure 1:
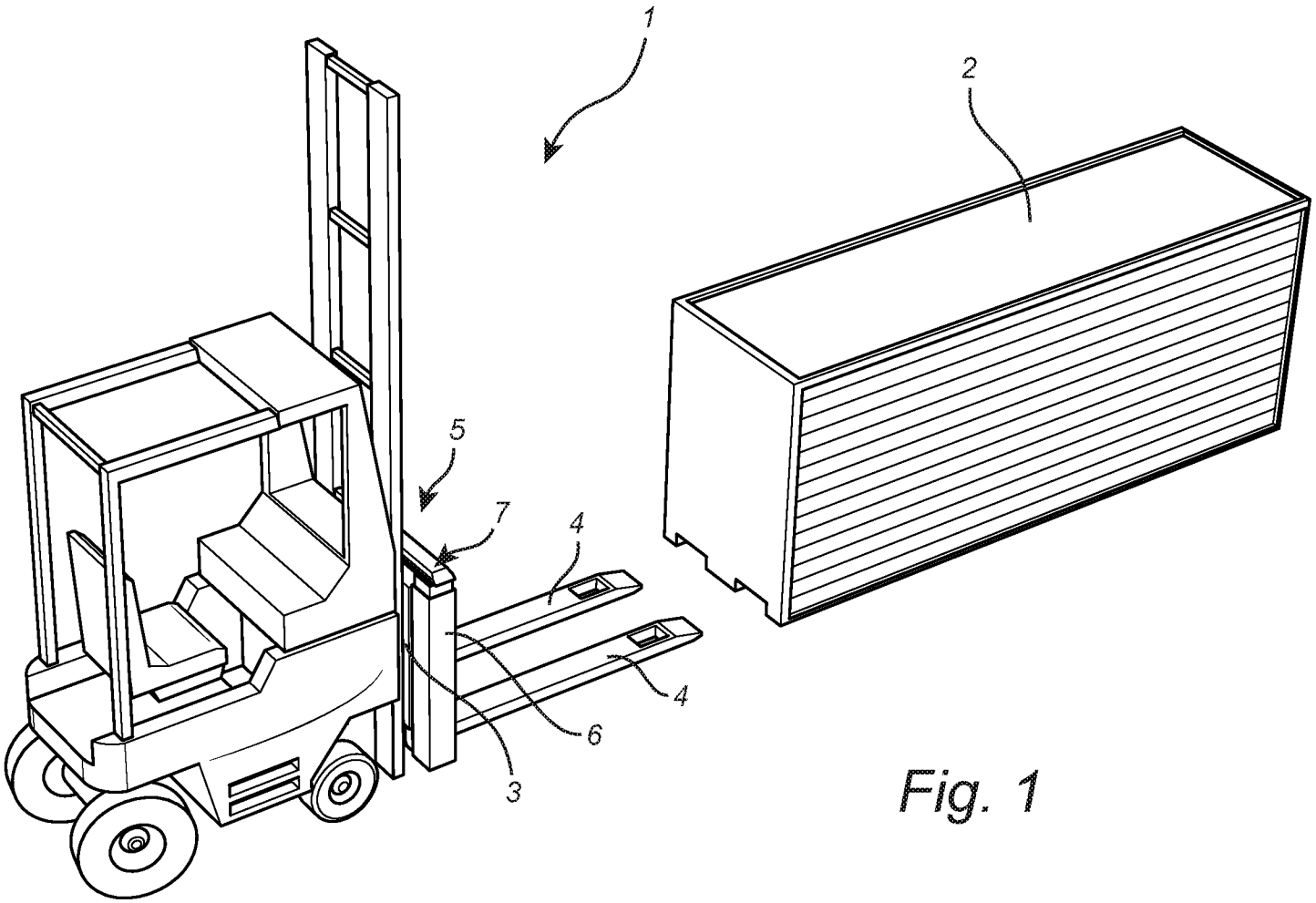
FIG. 1 is a perspective view of an exemplary embodiment of a clamping device according to a first aspect of the invention when attached to an exemplary embodiment of a forklift for transporting a load according to a second aspect of the invention.

FIG. 1 illustrates a forklift 1 for transporting a load 2. The forklift 1 comprises a main body 3 and two forks 4 connected to thereto for carrying the load 2. The forklift 1 is equipped with a clamping device 5. The clamping device 5 has a body 6 which is attached to a side surface of the main body 3 of the forklift 1. The clamping device 5 further comprises a clamping arm 7 which is connected to the body 6 and moveable in relation to the body 6, and a drive unit arranged to move the clamping arm 7.

In the FIGS. 2*a* to 2*d*, the loading sequence of a load 2 onto the forklift 1 is illustrated in detail.

The clamping arm 7 is movable between an idle position (FIG. 2*a* and FIG. 2*b*), in which the clamping arm is located outside of the loading area and in which it rests on a top surface of the main body of the forklift 1, and a working position (FIG. 2*c*), in which the clamping arm 7 is located in the loading area of the forklift 1 in order to secure the load 2 that is carried by the forklift 1.

Figure 2A:
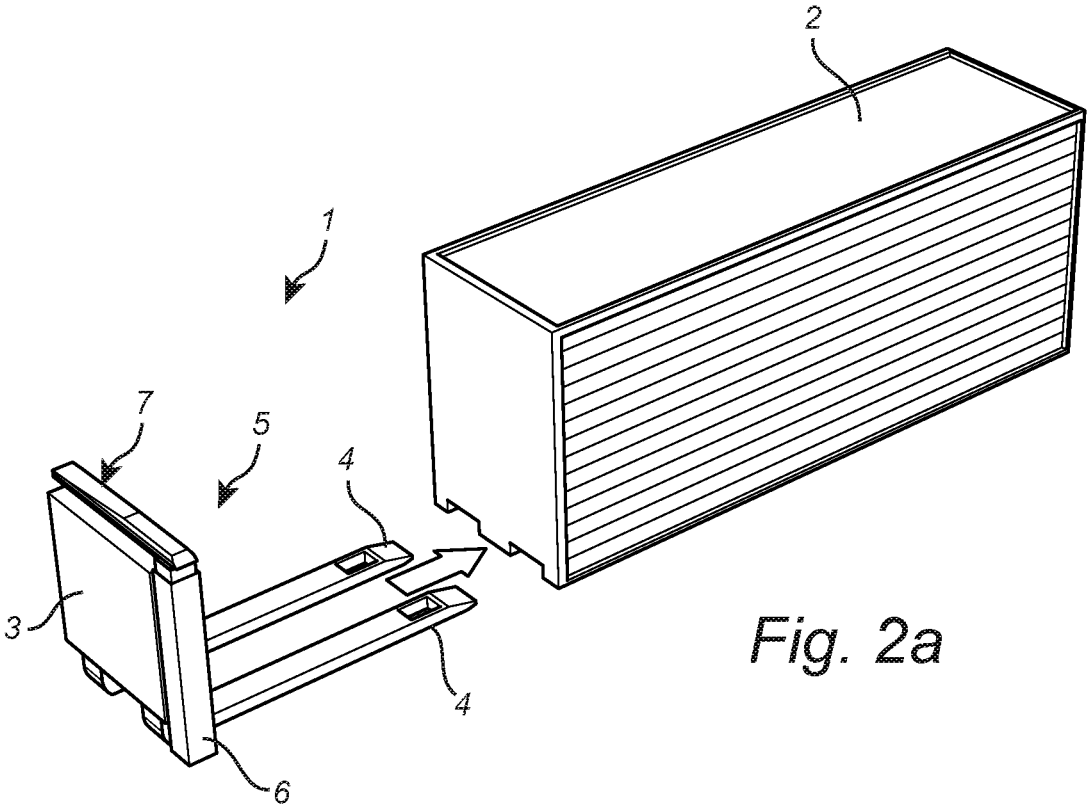
FIG. 2*a*-2*d* are perspective views of a loading sequence for the forklift in FIG. 1.
Figure 2B:
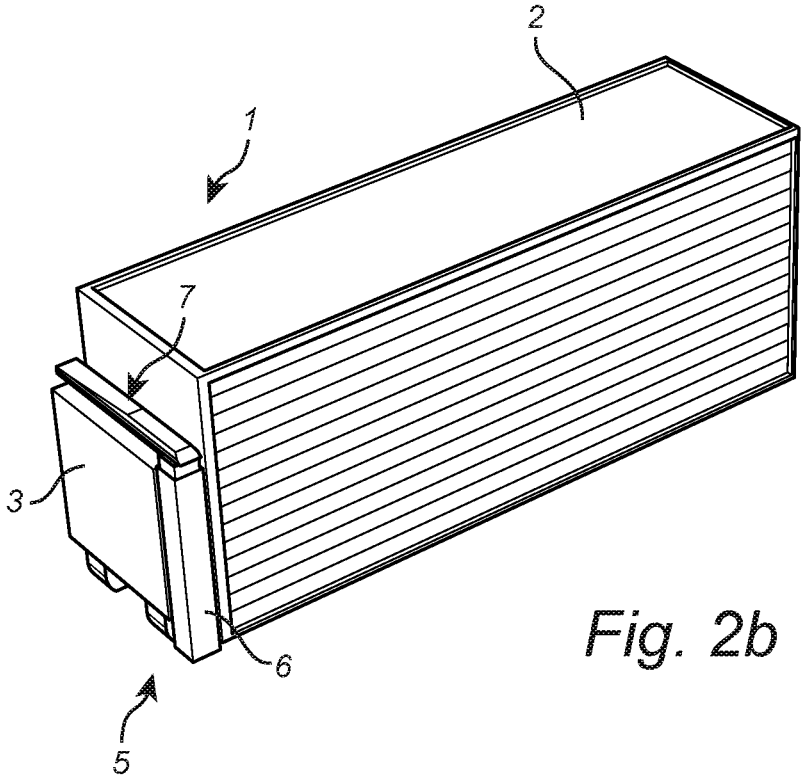
Figure 2C:
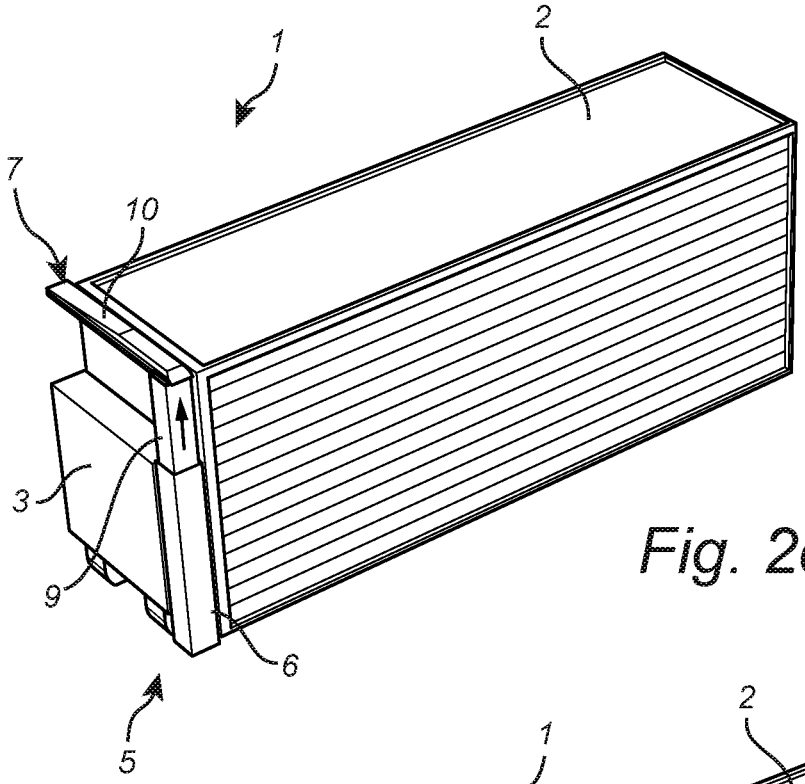
Figure 2D:
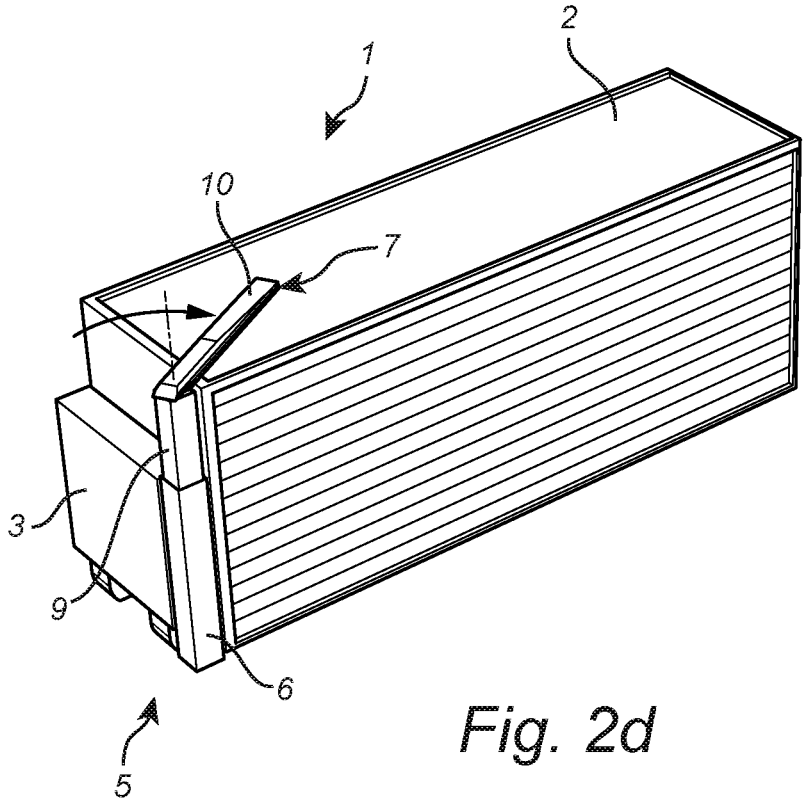

The clamping arm 7 has a first portion 9 which is movable in relation to the body 6 in a vertical direction and a second portion 10 which is pivotable in the horizontal plane (FIG. 2*d*). The second portion 10 of the clamping arm 7 is pivotably arranged to the first portion 9 of the clamping arm 7, which makes the second portion 10 of the clamping arm 7 vertically pivotable in relation to the first portion 9 of the clamping arm 7.

The drive unit (not shown) comprises a first drive means (not shown) for moving the first portion 9 of the clamping arm 7 and a second drive means (not shown) for driving the second portion 10 of the clamping arm 7.

The second portion 10 of the clamping arm 7 has a sensor (not shown) which is connected to a control unit (not shown). The sensor is used to detect the height of the load to be transported by means of the forklift 1. The control unit will use the detected height information from the sensor in order to guide the clamping arm 7 in relation to the load by means of the drive unit.

When a load 2 is to be transported by means of the forklift 1, the load 2 is arranged on the two forks 4 as an initial step while the clamping arm 7 of the clamping device 5 is in an idle position (FIG. 2*a* and FIG. 2*b*). When the load 2 has be arranged on the forks 4 of the forklift 1, the clamping arm 7 is moved into the loading area (FIG. 2*c* and FIG. 2*d*) in order to secure the load. The first portion 9 clamping arm 7 is moved in the vertical direction at a distance depending on the height of the load 2. When the first portion 9 of the clamping arm 7 has been vertically adjusted, the second portion 10 of the clamping arm 7 is pivoted in the horizontal plane in order to clamp the load 2 and thereby secure the same in relation to the forklift 1. By means of sensors, the control unit will know when an appropriated force is applied to the load 2 by means of the clamping arm 7. At this stage, the drive unit of the clamping device 5 will be instructed to stop and hold the clamping arm 7 until the transport of the load 2 is completed.

The clamping device 5 can be completely controlled from inside the operating cabin of the forklift 1.

The skilled person realizes that a number of modifications of the embodiments described herein are possible without departing from the scope of the invention, which is defined in the appended claims.

For instance, the sensors of the clamping device 5 may be constituted by any type of suitable sensor, such a pressure sensor, an optical sensor or a proximity sensor.

The invention claimed is:

1. A clamping device for a forklift, comprising a body connectable to the forklift at a loading area thereof, a clamping arm connected to the body, the clamping arm being moveable in relation to the body, and a drive unit arranged to move the clamping arm between an idle position, in which the clamping arm is located outside of the loading area, and a working position, in which the clamping arm has been moved into the loading area to secure a load carried by the forklift, wherein a first portion of the clamping arm is movable in relation to the body in a vertical direction and a second portion of the clamping arm is pivotable in the horizontal plane, the second portion of the clamping arm being pivotably arranged to the first portion of the clamping arm.

2. The clamping device according to claim 1, wherein the second portion of the clamping arm is vertically pivotable.

3. The clamping device according to claim 1, wherein the drive unit comprises a first drive means for moving the first portion of the clamping arm and a second drive means for driving the second portion of the clamping arm.

4. The clamping device according to claim 1, further comprising at least one sensor arranged on the clamping arm and connected to a control unit, the control unit being adapted to control the drive unit based on information from the at least one sensor.

5. The clamping device according to claim 4, wherein the control unit is adapted to stop the drive unit based on a load threshold value of the drive unit, the drive unit being the sensor.

6. The clamping device according to claim 1, wherein the at least one sensor comprises any one chosen from a group consisting of a pressure sensor, an optical sensor and a proximity sensor.

7. The clamping device according to claim 1, wherein the clamping device is controlled by a control system.

8. The clamping device according to claim 7, wherein the control system is remotely operated by a driver.

9. The clamping device according to claim 1, wherein one or more of the idle position or the working position is indicated by one or more of a light signal or a sound signal.

10. A forklift for transporting a load, comprising a main body, at least two forks connected to the main body of the forklift for carrying a load, and a clamping device according to claim 1, wherein the body of the clamping device is attached to the forklift at a side surface of the main body thereof.

* * * * *